United States Patent [19]

Skinner

[11] 4,376,421

[45] Mar. 15, 1983

[54] DOWNED AIRCRAFT POSITION INDICATOR

[76] Inventor: Glenn R. Skinner, 621 S. Mayo Dr., Tarpon Springs, Fla. 33589

[21] Appl. No.: 138,543

[22] Filed: Apr. 9, 1980

[51] Int. Cl.[3] ..... G08B 5/00; G08B 5/40

[52] U.S. Cl. ..... 116/211

[58] Field of Search ..... 116/211, 209, 210, 214, 116/200

[56] References Cited

U.S. PATENT DOCUMENTS

| | | | |
|---|---|---|---|
| 2,836,143 | 5/1958 | Shofi | 116/211 |
| 2,923,917 | 2/1960 | McPherson | 116/210 |
| 3,137,458 | 6/1964 | Hagan | 116/209 |

*Primary Examiner*—Kyle L. Howell
*Assistant Examiner*—Denis E. Corr
*Attorney, Agent, or Firm*—Ronald E. Smith

[57] ABSTRACT

Apparatus for visually indicating the position of a downed aircraft to rescue personnel. A bright yellow or lime-like in color substance is stored in at least one pressurized tank during flight, and means are provided whereby said substance is expelled from said aircraft responsive to separation of the craft's wings from the craft's fuselage, to operator-initiated control signals, or responsive to signals from a timing device.

Rupturable substance-containing or substance-transmitting lines disposed in fluid communication with said tank or tanks, extend at least in part from the fuselage to the wings so that removal of a wing automatically causes the expulsion of at least a portion of the substance.

The storage tanks are preferably chambered so that such line rupture allows only one chamber of such tank or tanks to empty, so that the remaining substance-containing chamber may be emptied responsive to operator-initiated signals or to timing device signals.

7 Claims, 1 Drawing Figure

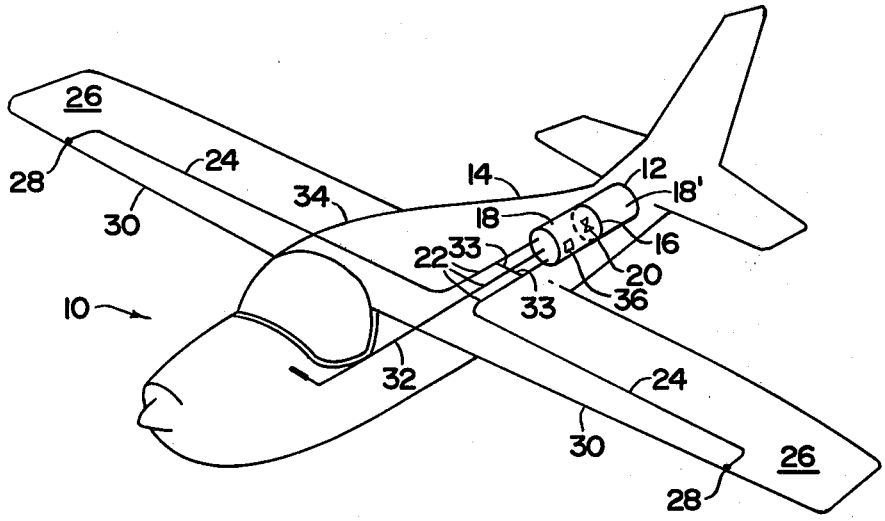
26
28
24
30
34
14
12
18'
18
16
22
33
20
36
33
10
32
24
30
26
28

DOWNED AIRCRAFT POSITION INDICATOR

BACKGROUND OF THE INVENTION

1. Field of the Invention

This invention relates generally to devices of the type designed to aid survivors of aircraft crashes by aiding rescue personnel searching for such downed aircraft in their efforts to visually locate such aircraft, and more particularly relates to an apparatus for effecting the expulsion of a highly visible substance from the aircraft once it is on the ground.

2. Description of the Prior Art

A search of the patent literature has indicated that an apparatus having the desirable features of the present invention has not heretofore been known or suggested.

SUMMARY OF THE INVENTION

The longstanding but unfulfilled need for an apparatus that would aid search and rescue personnel and hence crash survivors, is now fulfilled in an apparatus incorporating at least one pressurized storage tank and a pair of rupturable lines in fluid communication with said storage tank, which rupturable lines extend at least in part between the fuselage of the craft and its wings so that separation of the wings from the fuselage ruptures said lines and effects the expulsion of a highly visible substance from said tank onto the earth and vegetation adjacent the sight of the downed aircraft.

Manual means are also provided so that said substance can be expelled from said tank even if said wings are not separated from the fuselage. Further, an automatic timing device periodically dispenses said substance from said tank in lieu of operator-initiated expulsions, whether the wings are separated from the fuselage or not.

A tank or tanks may be mounted in the fuselage, the wings, or in both the fuselage and the wings. Regardless, however, of the particular embodiment, the storage tanks are partitioned into at least two chambers so that line rupture only partially evacuates the tank, by emptying only one of the said chambers, so that substance remaining in the non-evacuated chamber can be released therefrom either manually or by the timing device.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawing, in which:

FIG. 1 is a perspective view of an aircraft equipped with the preferred embodiment of the invention.

DETAILED DESCRIPTION OF THE PREFERRED EMBODIMENT

FIG. 1 indicates that a pressurized storage tank, designated 12 as a whole, is mounted interiorly of the fuselage portion 14 of an aircraft that is generally designated 10. The tank 12 is partitioned as at 16 so that two separate compartments 18,18' are formed therein. A normally closed valve means 20 is provided in the partition wall 16, and its function will be explained hereinafter.

A plurality of conduits or lines, collectively designated 22, emanates from the forward compartment 18 of the tank 12. Two of the lines 24,24 lead from the forward compartment 18 to opposite ones of the wings 26,26 of the aircraft 10, and each of said lines 24,24 terminates in different ones of the nozzle members 28,28 that are disposed on the leading edges 30,30 of each wing 26,26.

A third line 32 emanates from the forward compartment 18 of the tank 12 and terminates at a control valve (not shown) located in the cockpit of the aircraft 10, and is therefore manually operated by any occupant of the aircraft 10, whether pilot, co-pilot, navigator, or passenger. It should be observed that the line 32 is interconnected as at 33 with each of the lines 24,24.

Each compartment 18,18' of the tank 12 is pressurized and filled with a yellow or lime in color, highly visible substance that has sufficient tackiness to enable it to cling to vegetation, rocks, and other terrain objects even when attacked by rain, wind, snow, or other forms of inclement weather.

When an aircraft loses a wing upon landing, such substance, which may be of liquid, gaseous, or powdered form, as long as it is light in weight, will be expelled from compartment 18 and will be blown, under pressure, out of line 24, onto the surrounding terrain. The substance will exit the line 24 at the point of rupture thereof. Wing shearing normally occurs where the wing 26 and the fuselage 14 meet, shown in the drawings as 34, generally. In this manner, the substance contained in compartment 18 is deposited outwardly of the aircraft so that rescue personnel can more readily locate its position.

It should also be understood that a rupture of the tank 12 itself will result in escape of the substance therefrom. In such a circumstance, there would be no need for lines 22.

Some forced landings do not result in wing shearing. Accordingly, line 32 is manually operable so that the substance can be expelled from compartment 18 through the nozzles 28,28.

A pilot may elect to cause the ejection of the substance from the nozzles 28,28 even prior to an unscheduled landing, to aid rescue personnel by making a wider dispursion of the substance. For this reason, the nozzles 28,28 are preferably located on the leading edges 30,30 of the wings 26,26 so that spreading of the substance over a wide area is enhanced as a result of the air flow present from the leading edge to the trailing edge of each wing, which air flow, of course, provides the lift needed for flight.

It will also be appreciated that wing shearing will allow the entire contents of compartment 18 to be expelled therefrom. In situations, however, wherein a heavy snowfall or rainfall is occuring at the time of the aircraft downing, such weather conditions could erase the initial depositing of the substance on the terrain.

It is for this reason that the second substance-filled compartment 18' is provided. Unless the second compartment 18' ruptures on impact, the substance contained therein will not be expelled therefrom attendant wing shearing, since valve means 20, earlier mentioned, is normally closed. However, since substance-obliterating storms could arise, (and, indeed, in many situations, such a storm will have contributed to the forced landing), a pressure-sensitive device 36 is provided interiorly of compartment 18, for detecting pressure drops within compartment 18 below a preselected threshhold level. The device 36, when it has sensed a drop in compartment 18 pressure (which drop occurs when the substance has been expelled therefrom), actuates a timing device (not shown), that in turn periodically opens and closes valve 20 in accordance with a preselected time schedule.

For example, the timing device could be set to open valve 20 briefly approximately 30 seconds after the pressure sensitive device 36 recorded a drop in compartment 18 pressure, indicating, as aforesaid, discharge of the substance from compartment 18. Thereafter, the timing device opens the valve 20 briefly at 30 minute intervals to thereby continually re-mark the terrain adjacent the downed aircraft.

Since compartment 18' is pressurized, opening valve 20 allows substance in compartment 18' to mark the terrain by following the same route taken by the previously discharged substance that had been in compartment 18. This avoids any need for additional lines to service compartment 18'.

A number of auxiliary elements, not shown, are contemplated, to enhance the routine maintenance of the invention. The tank 12 will normally be mounted just rearwardly of the luggage compartment of the aircraft. Thus, it is convenient to provide, within the luggage compartment, pressure gauges (not shown) for monitoring the pressure in compartments 18, 18, line 22 shut-off valves (not shown), substance re-charging spouts (not shown) for both compartments 18,18' of the tank 12, and air valves (not shown) for re-pressurizing the compartments 18,18' as needed.

The line shut-off valves would normally be left fully open so that wing shearing would result in substance flow therethrough as desired, but such valves would be closed when the compartments 18,18' were being recharged with the highly visible substance through the charging spouts, or when the compartments 18,18' were being re-pressurized through the air valves.

Alternatively, a door (not shown) could be provided in the luggage compartment rear wall to allow access into the fuselage portion of the aircraft where all or some of the gauges, valves, or spouts could be located.

It will thus be seen that the objects made apparent by the preceding description are efficiently attained, and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Now that the invention has been described,

That which is claimed is:

1. An apparatus for indicating the position of a downed aircraft, comprising, a sealed storage tank means fixedly secured to said aircraft and disposed internally thereof, within the fuselage portion of said aircraft, so that said storage tank offers no wind resistance to the forward progress of said aircraft when in flight, said storage tank containing a preselected substance of the type readily visible when the substance is spread upon the earth or foilage, and means for expelling said substance from said tank while said tank remains fixed to said aircraft to facilitate rescue of personnel.

2. The apparatus of claim 1, further comprising, at least one conduit means disposed in fluid communication with and extending from said internally-mounted storage tank means to a preselected point internally of at least one of the wings of said aircraft so that separation of at least one of said wings would effect expulsion of said substance from said storage tank means through said conduit means.

3. The apparatus of claim 2, further comprising, at least one nozzle means mounted on at least one wing of said aircraft and disposed in open communication with the environment externally of said wing, said nozzle means disposed in fluid communication with said conduit means, and passenger-operated means for causing the release of said substance through said nozzles so that said substance can be released even in the absence of wing shearing.

4. An apparatus for indicating the position of a downed aircraft, comprising, a sealed storage tank fixedly secured to said aircraft at a preselected location internally or externally of the fuselage portion of said aircraft, said sealed storage tank partitioned to define separate compartment portions thereof, a readily visible substance contained within each of said compartments, at least one conduit means disposed in fluid communication between only one of said compartments and at least one of the wings of said aircraft so that only one of said substance-containing compartments will empty attendant wing shearing.

5. The apparatus of claim 4, wherein a pressure-sensitive device monitors the pressure in the compartment in fluid communication with said conduit means, and wherein means are provided to cause the non-conduit related compartment to empty when said device detects a pressure drop in said conduit-related compartment of sufficient degree to indicate a discharge of said substance from said compartment.

6. The apparatus of claim 5, wherein said means for emptying said non-conduit related compartment comprises a timing device activated by said pressure-sensitive device when said device detects a pressure drop, and wherein said timing device opens a valve means provided in said partition so that substance contained within said non-conduit related compartment enters said conduit-related compartment attendant opening of said valve means and is expelled therefrom via said conduit means.

7. The apparatus of claim 6, wherein said timing device periodically opens and closes said valve means in accordance with a predetermined time schedule to conserve said substance and to continually re-mark the terrain adjacent the downed aircraft.

* * * * *